US007445046B2

(12) United States Patent
Borak, Jr.

(10) Patent No.: US 7,445,046 B2
(45) Date of Patent: Nov. 4, 2008

(54) NESTED VELOCITY STRING TUBING HANGER

(75) Inventor: Eugene A. Borak, Jr., Cypress, TX (US)

(73) Assignee: Vetco Gray Inc., Houston, TX (US)

( * ) Notice: Subject to any disclaimer, the term of this patent is extended or adjusted under 35 U.S.C. 154(b) by 294 days.

(21) Appl. No.: 11/157,062

(22) Filed: Jun. 20, 2005

(65) Prior Publication Data

US 2005/0284640 A1 Dec. 29, 2005

Related U.S. Application Data

(60) Provisional application No. 60/583,324, filed on Jun. 28, 2004.

(51) Int. Cl.
*E21B 33/03* (2006.01)

(52) U.S. Cl. ..... 166/313; 166/75.14; 166/97.5; 166/368

(58) Field of Classification Search ..... 166/313, 166/75.14, 369, 285, 97.5, 75.11, 368, 335
See application file for complete search history.

(56) References Cited

U.S. PATENT DOCUMENTS

| | | | | |
|---|---|---|---|---|
| 3,177,942 | A * | 4/1965 | Haeber | 166/359 |
| 4,262,748 | A | 4/1981 | Kirkland | |
| 5,236,037 | A | 8/1993 | Watkins | |
| 5,462,119 | A | 10/1995 | De Souza et al. | |
| 2003/0006041 | A1 | 1/2003 | Baten et al. | |
| 2003/0141071 | A1 * | 7/2003 | Hosie | 166/350 |

* cited by examiner

*Primary Examiner*—Jennifer H Gay
*Assistant Examiner*—Brad Harcourt
(74) *Attorney, Agent, or Firm*—Bracewell & Giuliani

(57) ABSTRACT

An outer tubing hanger is secured to an outer string of tubing and landed in a wellhead housing. A Christmas tree is connected to the wellhead housing. While in a first mode, an isolation tube extends between the tree and the outer tubing hanger for conveying well fluid flowing up the outer string of tubing. The isolation tube is removed while in a second mode, and an inner tubing hanger secured to an inner string of tubing lands in the outer tubing hanger production passage. An upper portion of the inner tubing hanger extends into sealing engagement with the tree production passage for flowing well fluid up the inner string of tubing while in the second mode.

17 Claims, 2 Drawing Sheets

NESTED VELOCITY STRING TUBING HANGER

This application claims the benefit of provisional application Ser. No. 60/583,324, filed Jun. 28, 2004.

FIELD OF THE INVENTION

This invention relates in general to oil and gas wellhead equipment, and in particular to a tubing hanger that has provisions for installing an inner tubing hanger and inner string tubing.

BACKGROUND OF THE INVENTION

A typical oil or gas well has a wellhead housing with a Christmas tree mounted thereon. One or more strings of casing extend into the well and are supported by casing hangers landed in the wellhead housing. In one type of wellhead assembly, a tubing hanger lands in the wellhead housing. The tubing hanger supports a string of production tubing suspended in the casing. Well fluid flows up the tubing to the tree. If the wellhead assembly is a surface installation, rather than subsea, normally the wellhead has a tubing annulus access port extending through its sidewall. The access port is located below the tubing hanger seal to provide access to the tubing annulus.

In some wells a minimum velocity of the well fluid is desired as it flows through the tubing hanger. As the formation is depeleted, the bottom hole pressure declines, causing a reduction in velocity. An inner string of tubing may be installed in the previously installed tubing. In one technique, the tree is removed, and a tubing spool or tubing head is connected to the upper end of the wellhead housing. The inner string of tubing is lowered into the existing tubing, and an inner tubing hanger lands in the tubing spool. The inner string of tubing may be joints of production tubing secured together by threaded ends, or it may comprise a continuous string of coiled tubing. After securing the inner tubing hanger in the tubing spool, the tree is connected to the tubing spool. While workable, this adaptation increases the overall height of the wellhead assembly, which can create problems, particularly for wellhead assemblies mounted on offshore platforms.

SUMMARY OF THE INVENTION

In this invention, while in a first mode, well fluid flows up an outer tubing string and through an outer tubing hanger into a Christmas tree. For a second mode, the tree is removed and an inner string of tubing is lowered into the outer string of tubing. An inner tubing hanger lands and seals in the production passage of the outer tubing hanger. The tree is reconnected to the wellhead housing, and well fluid flows up the inner string of tubing into the tree.

Both the outer and inner tubing hangers have penetrator passages in the preferred embodiment. The penetrator passages connect to hydraulic lines extending alongside the tubing strings to downhole safety valves.

In the embodiment shown, an isolation tube extends between the productions passages in the tree and in the outer tubing hanger while in the first mode. The isolation tube is removed and replaced by the inner tubing hanger when converting to the second mode.

Preferably, access to the inner tubing annulus is provided by a port extending from the outer tubing hanger passage to the exterior of the outer tubing hanger. The wellhead housing has an inner tubing annulus port that registers with the one in the outer tubing hanger. While in the first mode, the isolation tube blocks the access of the ports to the production passages. While in the second mode, the inner tubing hanger seals above the port in the outer tubing hanger.

DETAILED DESCRIPTION OF THE INVENTION

Figure 1:
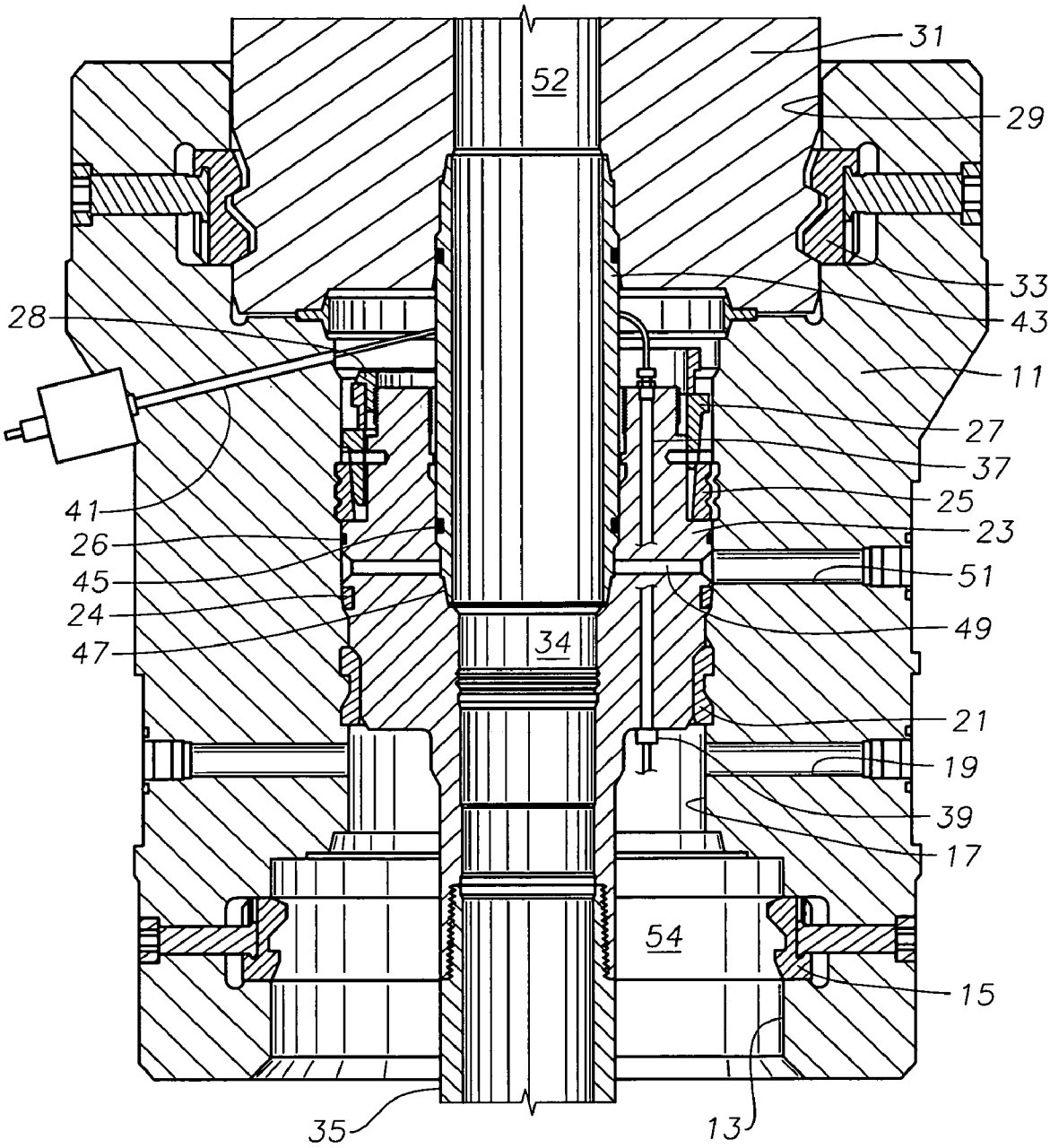
FIG. 1 is a sectional view of an outer tubing hanger constructed in accordance with this invention, and shown in a mode for production through an outer tubing string.

Referring to FIG. 1, wellhead housing 11 locates at the upper end of a well, and it may also be referred to as a tubing spool, tubing head, or wellhead member. Wellhead housing 11 has a lower bore section 13 that receives an upper end of a lower tubular member (not shown) of the well, such as a casing head. The casing head will contain one or more casing hangers (not shown). Each casing hanger is at the upper end of a string of casing that is cemented in the well. A clamp member 15 secures wellhead housing 11 to the lower tubular member. Wellhead housing 11 has a central bore section 17 that has a smaller diameter than lower bore section 13. An outer tubing annulus port 19 extends laterally through the sidewall of wellhead housing 11 from central bore section 17 to the exterior of wellhead housing 11 for connection to a flow line (not shown).

Central bore section 17 has an upward facing load shoulder 21. In this embodiment, load shoulder 21 is a separate ring installed within a profile in central bore section 17. However, it could alternately be machined in central bore section 17. An outer tubing hanger 23 lands on load shoulder 21 within central bore section 17 in a conventional manner. Outer tubing hanger 23 has a seal 24 that seals to central bore section 17. In this embodiment, a second seal 26 is spaced axially above seal 24 for sealingly engaging central bore section 17. Seals 24, 26 are shown as elastomers, but metal-to-metal seals could also be used.

A lock ring 25 secures outer tubing hanger 23 in central bore section 17. Lock ring 25 is a split ring in this embodiment that engages a mating profile in central bore section 17. The left portion of FIG. 1 shows lock ring 25 in a set position and the right side shows lock ring 25 prior to setting. An actuator 27, when moved downward, pushes lock ring 25 out into the mating profile to cause it to set. A retainer ring 28 secures to threads on tubing hanger 23 to hold actuator 27 in the lower locked position. Different locking arrangements for outer tubing hanger 23 are feasible.

An upper bore section 29 extends upward from central bore section 17 above outer tubing hanger 23. Upper bore section 29 has a larger diameter than central bore section 17 for receiving the lower end of a Christmas tree 31. A locking member 33, typically comprising dogs similar to locking member 15, secures the lower end of tree 31 to the upper end of wellhead housing 11.

Tubing hanger 23 has a vertical production passage 34 extending through it that communicates with a string of outer tubing 35 that extends downward into the well. Outer tubing 35 may be made up of individual sections of pipe secured together by threads, or tubing 35 could be a continuous string of coiled tubing. Unlike casing, outer tubing 35 is not cemented in the well. A penetrator passage 37 extends vertically from the upper end to the lower end of outer tubing hanger 23, offset from tubing hanger passage 34. A downhole hydraulic line 39 extends from the lower end of penetrator passage 37 to a downhole safety valve (not shown) located in outer tubing 35. An uphole hydraulic line 41 extends from the upper end of penetrator passage 39 and through a passage in the side wall of wellhead housing 11 to the exterior. Hydraulic pressure is maintained in hydraulic lines 41 and 39 to keep the downhole safety valve open.

An isolation tube 43 has a lower end that slides into tubing hanger production passage 34. Isolation tube 43 has a pair of seals 45, 47 that sealingly engage passage 34. Upper seal 45 is shown as an elastomeric seal, and lower seal 47 is shown as a metal-to-metal seal. A lateral passage 49 extends radially outward through outer tubing hanger 23 from passage 34 for communication with a lateral passage 51 extending through the sidewall of wellhead housing 11. A circular annular groove is preferably located at the outer end of lateral passage 49 to avoid having to orient tubing hanger 23 to align passages 49 and 51 on a common axis. Seal 24 is located below lateral passage 49, and seal 26 is located above lateral passage 49. Seals 45, 47 on isolation tube 43 locate above and below lateral passage 49. In the first operational mode, which is shown in FIG. 1, seal 47 of isolation tube 43 blocks lateral passage 49 from communication with axial passage 34.

The upper end of isolation tube 43 extends into sealing engagement with a production passage 52 in tree 31. Tree 31 will have typical valves and a choke for controlling flow of well fluid.

While configured in the operational mode of FIG. 1, production well fluid flows up outer tubing string 35, through tubing hanger passage 34 and into tree production passage 52. Tubing annulus passage 19 provides access to an outer tubing annulus 54 surrounding outer tubing 35 for use during the completion and workover of the well. During completion and workover, the operator can circulate through outer tubing annulus 54 between tree production passage 52 and tubing annulus passage 19. During production, the operator may monitor any pressure within the tubing annulus 54 by connecting a gauge to outer tubing annulus passage 19. The operator controls the downhole safety valve (not shown) conventionally through hydraulic lines 41 and 39.

The mode shown in FIG. 1 is particularly useful for well fluid flow rates that are sufficiently high to maintain a desired velocity. When the well fluid flow rate decreases, the operator may wish to have a smaller diameter string of tubing to increase the velocity of the fluid as it flows up the tubing. This conversion is accomplished in FIG. 2 by removing tree 31 and isolation tube 43 and installing an inner tubing hanger 53. Inner tubing hanger 53 takes the place of isolation tube 43 (FIG. 1) and sealingly engages passage 34 of outer tubing hanger 23. Inner tubing hanger 53 has a lower threaded end secured to a string of inner tubing 55. Inner tubing 55 could also be sections of pipe secured together, or it may comprise a single continuous string of coiled tubing. Inner tubing hanger 53 has a seal 57 that sealingly engages passage 34 above lateral passage 49. Lateral passage 49 now communicates with an inner tubing annulus 58 surrounding inner tubing 55.

A lockdown ring 59 carried on the outer diameter of inner tubing hanger 53 engages a downward facing shoulder or profile 61 in tubing hanger passage 34. Lockdown ring 59 is preferably a split ring that is biased outwardly. A threaded counterbore 63 extends upward from profile 61 in outer tubing hanger passage 34. An annular space exists between the threads of counterbore 63 and inner tubing hanger 53. The operator may place a threaded release ring (not shown) into this annular space and rotate it within threaded counterbore 63. The release ring would then contact the upper end of lockdown ring 59 and cause it to contract inward to release from profile 61. This allows the operator to remove inner tubing hanger 53 at a later time, if desired. When isolation tube 43 is installed as shown in FIG. 1, an annular space will also exist between threaded counterbore 63 and the sidewall of isolation tube 43.

Similar to outer tubing hanger 23, inner tubing hanger 53 also has a penetrator passage 65 extending vertically through it from above to below seal 57. A downhole hydraulic line 67 secures to the lower end of penetrator 65 and leads to a downhole safety valve (not shown) in a string of inner tubing 55. An uphole hydraulic line 69 leads from penetrator passage 65 through a passage in the sidewall of wellhead housing 11 to the exterior for supplying hydraulic fluid pressure. The passage through wellhead housing 11 preferably differs from the passage for uphole hydraulic line 41 to enable the operator to maintain hydraulic pressure on both downhole safety valves.

Inner tubing hanger 53 has an upward protruding neck 71. Neck 71 extends above outer tubing hanger 23 and into a counterbore formed at the lower end of tree production passage 52. A seal 73 seals neck 71 to production passage 52.

Figure 2:
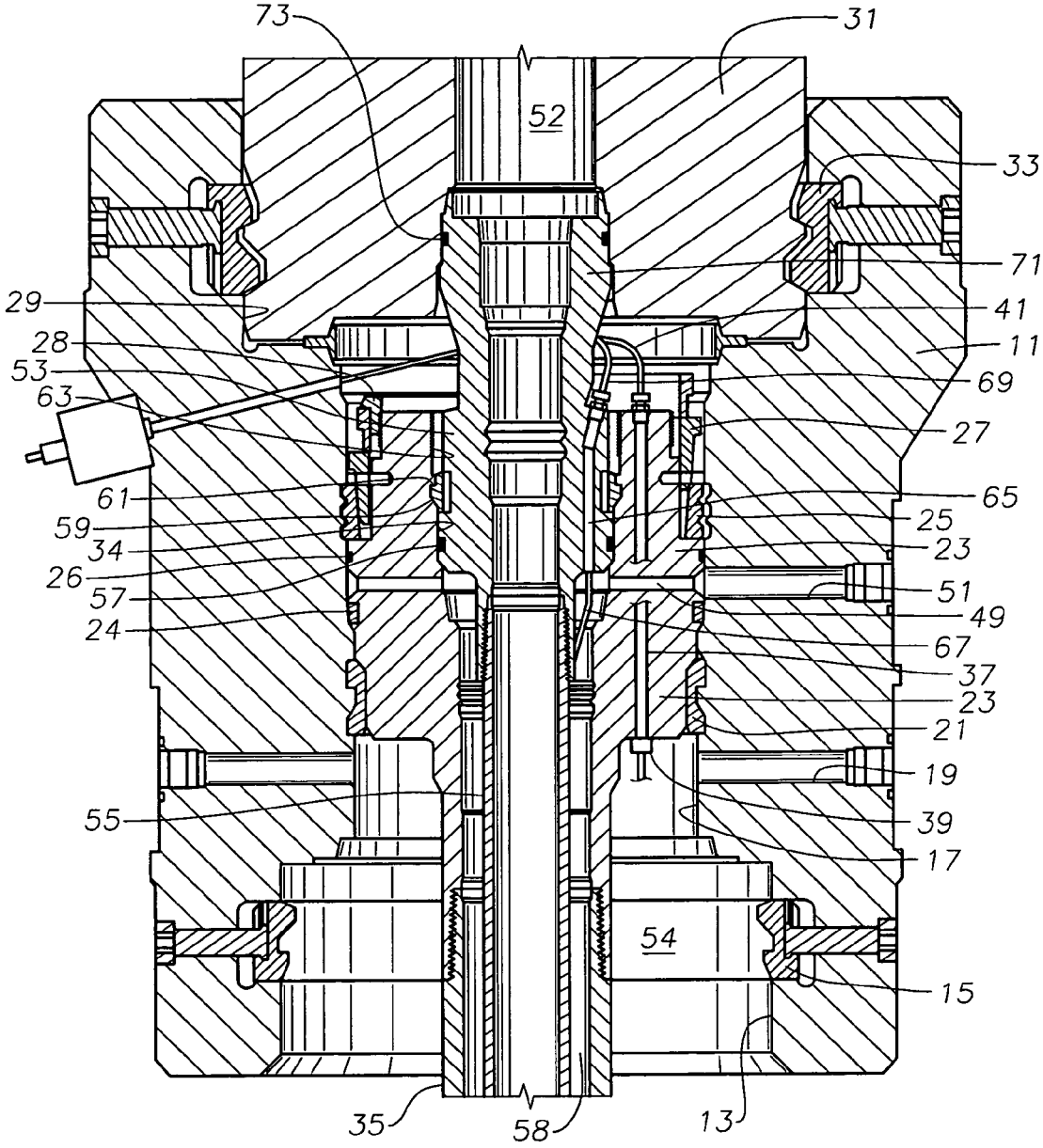
FIG. 2 is a sectional view of the outer tubing hanger of FIG. 1, and also showing an inner tubing hanger landed within the outer tubing hanger of FIG. 1 for a second mode of production.

To change from the mode of FIG. 1 to the mode of FIG. 2, the operator removes tree 31 and isolation tube 43 (FIG. 1). The operator runs inner tubing string 55 through outer tubing hanger passage 34 and outer tubing string 35 to a desired depth. The operator secures inner tubing hanger 53 to the upper end of inner tubing string 55 and lands it within passage 34 of outer tubing hanger 23. Lockdown ring 59 will snap into engagement with profile 61. The operator threads uphole hydraulic line 69 through a passage in wellhead housing 11 and maintains hydraulic pressure on the downhole safety valve (not shown). The operator installs tree 31 onto neck 71 and wellhead housing 11.

Well fluid will now flow up inner tubing string 55 through tree production passage 52 to the flow line. Any pressure in inner tubing annulus 58 communicates through lateral passages 49 and 51 to monitoring equipment at the surface. The operator can circulate between tree production passage 52 and inner tubing annulus 58 during completion and workover operations. The operator still maintains monitoring and control of outer tubing annulus 54.

The invention has significant advantages. The second mode of operation does not increase the height of the wellhead assembly. A tubing head or spool for the inner string of tubing is not required. The operator maintains access to outer tubing annulus while in the second mode.

While the invention has been shown in only one of its forms, it should be apparent to those skilled in the art that it is not so limited but is susceptible to various changes without departing from the scope of the invention.

The invention claimed is:

1. A wellhead assembly, comprising:

a wellhead housing;

an outer tubing hanger for securing to an outer string of tubing, the outer tubing hanger being landed in the wellhead housing, the outer tubing hanger having a production passage for receiving well fluid flowing up the outer string of tubing while in a first mode; and while in a second mode, an inner tubing hanger for securing to an inner string of tubing, the inner tubing hanger having a lower portion that is landed sealingly in the production passage of the outer tubing hanger, the inner tubing hanger having a production passage for receiving well fluid flowing up the inner string of tubing while in the second mode;

a tree connected to the wellhead housing, the tree having a production passage;

while in the first mode, an isolation tube extending from sealing engagement with the production passage of the outer tubing hanger to sealing engagement with the production passage of the tree; and while in the second mode, the isolation tube being removed and the inner tubing hanger having an upper portion extending into sealing engagement with the production passage of the tree.

2. A wellhead assembly, comprising:

a wellhead housing;

an outer tubing hanger for securing to an outer string of tubing, the outer tubing hanger being landed in the wellhead housing, the outer tubing hanger having a production passage for receiving well fluid flowing up the outer string of tubing while in a first mode; and while in a second mode, an inner tubing hanger for securing to an inner string of tubing, the inner tubing hanger having a lower portion that is landed sealingly in the production passage of the outer tubing hanger, the inner tubing hanger having a production passage for receiving well fluid flowing up the inner string of tubing while in the second mode;

a lock member extending between a profile in the production passage of the outer tubing hanger and a profile on an exterior portion of the inner tubing hanger for locking the inner tubing hanger to the outer tubing hanger.

3. The assembly according to claim 2, wherein:

in the second mode, the lower portion of the inner tubing hanger lands on a shoulder within the production passage of the outer tubing hanger.

4. The assembly according to claim 2, further comprising:

an outer penetrator passage extending through the outer tubing hanger for connecting to a hydraulic line extending alongside the outer string of tubing; and an inner penetrator passage extending through the inner tubing hanger for connecting to a hydraulic line extending alongside the inner string of tubing.

5. A wellhead assembly, comprising:

a wellhead housing;

an outer tubing hanger for securing to an outer string of tubing, the outer tubing hanger being landed in the wellhead housing, the outer tubing hanger having a production passage for receiving well fluid flowing up the outer string of tubing while in a first mode; and while in a second mode, an inner tubing hanger for securing to an inner string of tubing, the inner tubing hanger having a lower portion that is landed sealingly in the production passage of the outer tubing hanger, the inner tubing hanger having a production passage for receiving well fluid flowing up the inner string of tubing while in the second mode;

an outer tubing annulus port extending laterally through a sidewall of the wellhead housing for communicating with an outer tubing annulus surrounding the outer string of tubing;

an inner tubing annulus port extending laterally through the sidewall of the wellhead housing above the outer tubing annulus port; and an inner tubing annulus port extending from the production passage in the outer tubing hanger laterally through a sidewall of the outer tubing hanger and in communication with the inner tubing annulus port in the wellhead housing, for communicating with an inner tubing annulus between the inner and outer strings of tubing while in the second mode.

6. A wellhead assembly, comprising: a wellhead housing;

an outer tubing hanger for securing to an outer string of tubing, the outer tubing hanger being landed in the wellhead housing, the outer tubing hanger having a production passage for receiving well fluid flowing up the outer string of tubing while in a first mode; and while in a second mode, an inner tubing hanger for securing to an inner string of tubing, the inner tubing hanger having a lower portion that is landed sealingly in the production passage of the outer tubing hanger, the inner tubing hanger having a production passage for receiving well fluid flowing up the inner string of tubing while in the second mode;

a split lock ring carried by the inner tubing hanger and engaging a profile in the production passage of the outer tubing hanger; and a threaded section in the production passage of the outer tubing hanger above the lock ring for selectively receiving a release member to cam the lock ring out of engagement with the profile.

7. A wellhead assembly, comprising:

a wellhead housing;

an outer tubing hanger secured to an outer string of tubing and landed in the wellhead housing, the outer tubing hanger having an outer tubing hanger production passage;

an outer tubing hanger seal that seals between the outer tubing hanger and the wellhead housing;

a Christmas tree having a tree production passage and connected to the wellhead housing;

while in a first mode, an isolation tube extending between the tree and the outer tubing hanger production passages for conveying well fluid flowing up the outer string of tubing, the isolation tube being removed while in a second mode, the isolation tube having a lower end that stabs sealingly into the outer tubing hanger production passage and an upper end that stabs sealingly into the tree production passage in the first mode;

while in the second mode, an inner tubing hanger secured to an inner string of tubing, the inner tubing hanger having a lower portion landed in the outer tubing hanger production passage, and an upper portion that extends into sealing engagement with the tree production passage for conveying well fluid flowing up the inner string of tubing while in the second mode; and an inner tubing hanger seal that seals between the inner tubing hanger and the outer tubing hanger production passage.

8. The assembly according to claim 7, further comprising:

an outer hydraulic line extending alongside the outer string of tubing;

an outer penetrator passage connected to the outer hydraulic line and extending through the outer tubing hanger from below to above the outer tubing hanger seal;

an inner hydraulic line extending alongside an outer side of the inner string of tubing within the outer tubing; and an inner penetrator passage connected to the inner hydraulic line and extending through the inner tubing hanger from below to above the inner tubing hanger seal.

9. The assembly according to claim 7, further comprising:

a wellhead housing outer tubing annulus port extending laterally through a sidewall of the wellhead housing below the outer tubing hanger seal in communication with an outer tubing annulus surrounding the outer string of tubing;

a wellhead housing inner tubing annulus port extending laterally through the sidewall of the wellhead housing above the outer tubing hanger seal; and an outer tubing hanger inner tubing annulus port extending from the outer tubing hanger production passage laterally through a sidewall of the outer tubing hanger and in communication with the wellhead housing inner tubing annulus port; and while in the second mode, the inner tubing hanger seal being located above the point where the outer tubing hanger inner tubing annulus port joins the outer tubing hanger production passage, so that an inner tubing annulus between the inner and outer strings of tubing is in communication with the wellhead housing inner tubing annulus port.

10. The assembly according to claim 9, wherein the isolation tube blocks access from the outer tubing to the outer tubing hanger inner tubing annulus port while in the first mode.

11. The assembly according to claim 7, further comprising:

a split lock ring carried by the inner tubing hanger and engaging a profile in the outer tubing hanger production passage.

12. A method for producing a well, comprising:

securing an outer tubing hanger having a production passage to an outer string of tubing and landing the outer tubing hanger in a wellhead member;

while in a first mode, flowing the well fluid up the outer string of tubing and the production passage;

for a second mode, lowering an inner string of tubing into the outer string of tubing;

securing an inner tubing hanger to the inner string of tubing and landing and sealing a lower portion of the inner tubing hanger in the production passage of the outer tubing hanger; and flowing the well fluid up the inner string of tubing, locking the inner tubing hanger to the outer tubing hanger.

13. The method according to claim 12, further comprising:

while in the second mode, communicating a tubing annulus between the outer and inner tubing strings with an exterior portion of the wellhead member.

14. The method according to claim 12, wherein the outer tubing hanger has am outer penetrator passage that communicates an outer hydraulic line extending along the outer string of tubing with an exterior portion of the wellhead member; and wherein the method further comprises:

for the second mode, extending an inner hydraulic line alongside the inner string of tubing and providing the inner tubing hanger with a inner penetrator passage that communicates the inner hydraulic line with an exterior portion of the wellhead member.

15. The method according to claim 12, further comprising:

providing the wellhead member with a laterally extending passage;

providing the outer tubing hanger with a laterally extending passage leading from the production passage into communication with the laterally extending passage in the wellhead member;

blocking any flow through the laterally extending passages while in the first mode; and allowing flow from a tubing annulus between the inner and outer strings of tubing through the laterally extending passages while in the second mode.

16. The method according to claim 12, further comprising:

for the first mode, landing a Christmas tree on the wellhead member and flowing the well fluid from the production passage in the outer tubing hanger to the tree; and for the second mode, removing the tree to run the inner string of tubing and the inner tubing hanger, then replacing the tree on the wellhead member and flowing the well fluid from the inner tubing hanger to the tree.

17. The method of claim 12, further comprising:

for the first mode, landing a Christmas tree on the wellhead member, providing an isolation tube extending between the production passage in the outer tubing hanger and a passage in the tree, and flowing the well fluid from the production passage in the outer tubing hanger through the isolation tube to the passage in the tree; and for the second mode, removing the tree and the isolation tube to run the inner string of tubing and the inner tubing hanger, then replacing the tree on the wellhead member, extending an upper portion of the inner tubing hanger into sealing engagement with the passage in the tree, and flowing the well fluid from the inner tubing hanger into the passage in the tree.

* * * * *